US009707492B1

(12) United States Patent
Bernard et al.

(10) Patent No.: US 9,707,492 B1
(45) Date of Patent: Jul. 18, 2017

(54) SPARKING JUMP ROPE

(71) Applicants: Elaine Bernard, Culver City, CA (US); Vernon Lee Roddy, III, Culver City, CA (US); Julard Jaevon Roddy, Culver City, CA (US); Julianne Evona Roddy, Culver City, CA (US)

(72) Inventors: Elaine Bernard, Culver City, CA (US); Vernon Lee Roddy, III, Culver City, CA (US); Julard Jaevon Roddy, Culver City, CA (US); Julianne Evona Roddy, Culver City, CA (US)

( * ) Notice: Subject to any disclaimer, the term of this patent is extended or adjusted under 35 U.S.C. 154(b) by 0 days.

(21) Appl. No.: 15/053,938

(22) Filed: Feb. 25, 2016

(51) Int. Cl.
*A63B 5/20* (2006.01)
*A63H 33/36* (2006.01)

(52) U.S. Cl.
CPC ..... *A63H 33/36* (2013.01); *A63B 5/20* (2013.01)

(58) Field of Classification Search
CPC ..... A63B 5/20; A63B 2208/12; A63B 2071/0625; A63B 5/22; A63B 2207/02; A63B 21/0004; A63B 21/4043; A63H 33/36
USPC ..... 482/81–82
See application file for complete search history.

(56) References Cited

U.S. PATENT DOCUMENTS

| | | | | |
|---|---|---|---|---|
| 2001/0023220 | A1* | 9/2001 | Bouvier | A63B 5/20 482/82 |
| 2011/0077133 | A1* | 3/2011 | Oesterling | A63B 5/20 482/82 |
| 2014/0080680 | A1* | 3/2014 | Henniger | A63B 5/20 482/82 |
| 2014/0228180 | A1* | 8/2014 | Walker | A63B 5/20 482/82 |
| 2016/0067536 | A1* | 3/2016 | Carpinelli | A63B 5/20 482/82 |

* cited by examiner

*Primary Examiner* — Andrew S Lo
(74) *Attorney, Agent, or Firm* — Plager Schack LLP

(57) ABSTRACT

Some embodiments of the present disclosure include a sparking jump rope configured to emit sparks while a user is jumping rope. The sparking jump rope may include a rope; and a sparking portion positioned along a length of the rope, the sparking portion configured to create sparks when the jump rope contacts a ground surface. The sparking portion may be a solid piece of sparking material or a hollow portion configured to accommodate at least one spark rock. In some embodiments, the sparking portion may be a removable attachment, such that the sparking portion may be removably attached to any conventional jump rope.

2 Claims, 5 Drawing Sheets

SPARKING JUMP ROPE

BACKGROUND

The embodiments herein relate generally to toys and games, and more particularly, to a jump rope that sparks when it contacts the ground Conventional jump ropes consist of a rope, cord, or similar item with a handle at each end. However, conventional jump ropes lack excitement and flair.

Therefore, what is needed is a jump rope that sparks when it contacts the ground, bringing excitement back to jumping rope.

SUMMARY

Some embodiments of the present disclosure include a sparking jump rope configured to emit sparks while a user is jumping rope. The sparking jump rope may include a rope; and a sparking portion positioned along a length of the rope, the sparking portion configured to create sparks when the jump rope contacts a ground surface. The sparking portion may be a solid piece of sparking material or a hollow portion configured to accommodate at least one spark rock. In some embodiments, the sparking portion may be a removable attachment, such that the sparking portion may be removably attached to any conventional jump rope.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a jump rope that sparks when it contacts the ground and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Rope Portion
2. Spark Rock Portion

The various elements of the device of the present disclosure may be related in the following exemplary fashion. It is not intended to limit the scope or nature of the relationships between the various elements and the following examples are presented as illustrative examples only.

Figure 1:
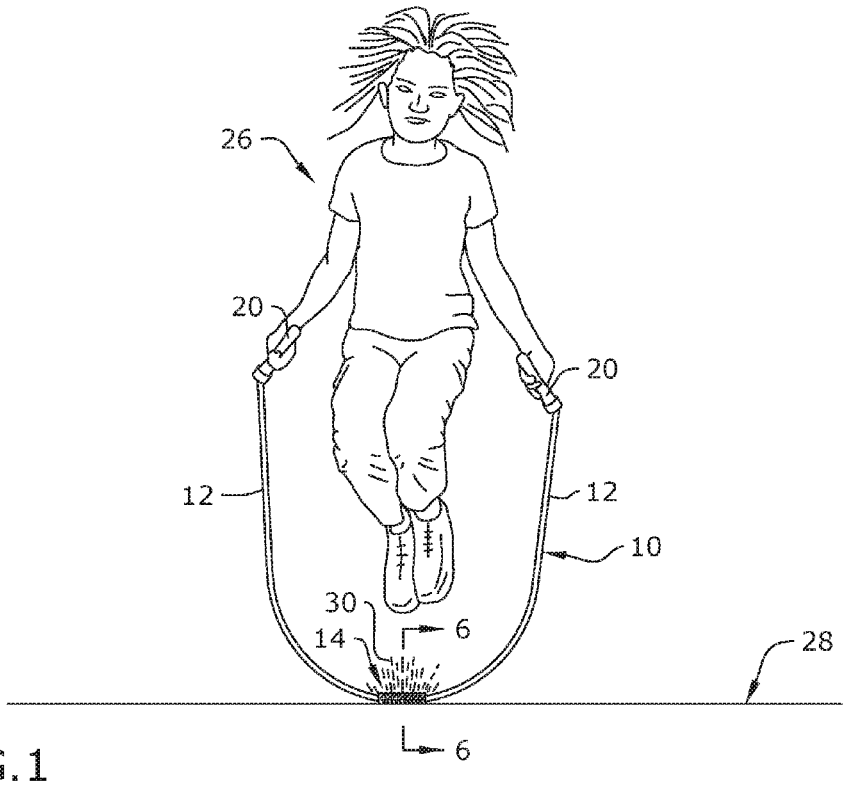
FIG. 1 is a perspective view of one embodiment of the present disclosure, shown in use.
Figure 2:
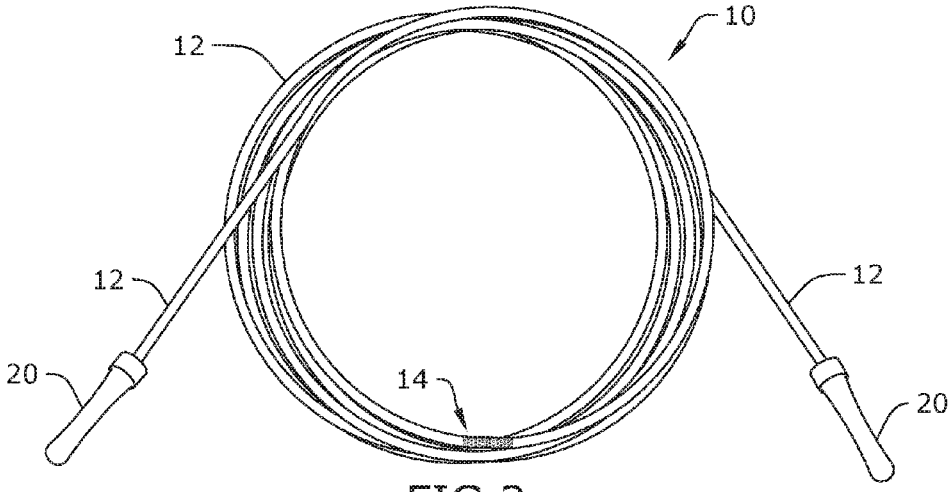
FIG. 2 is a perspective view of one embodiment of the present disclosure.
Figure 3:
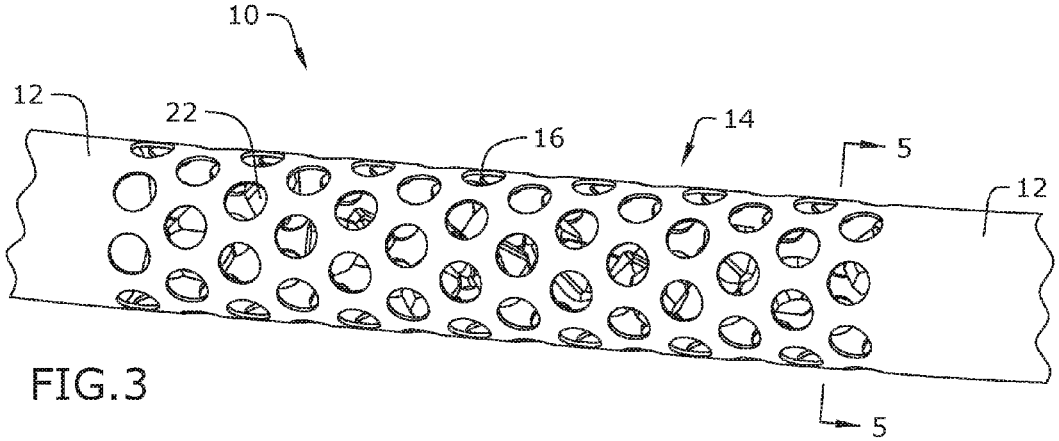
FIG. 3 is a detail perspective view of one embodiment of the present disclosure.
Figure 4:
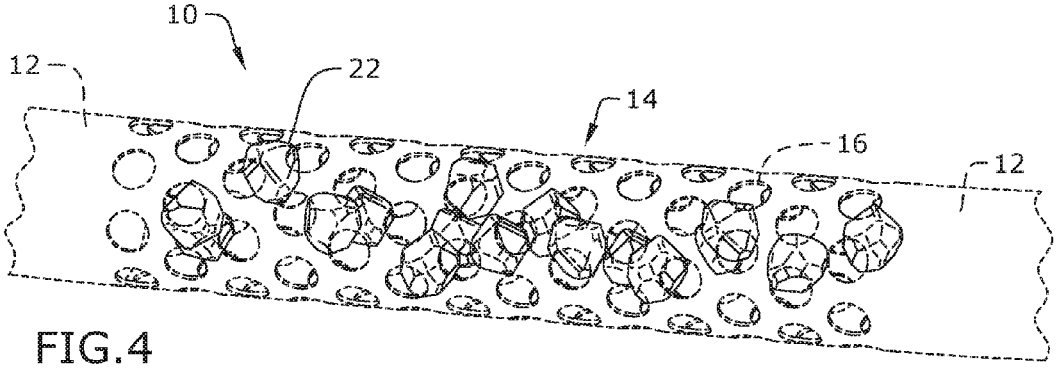
FIG. 4 is a detail perspective view of one embodiment of the present disclosure.
Figure 5:
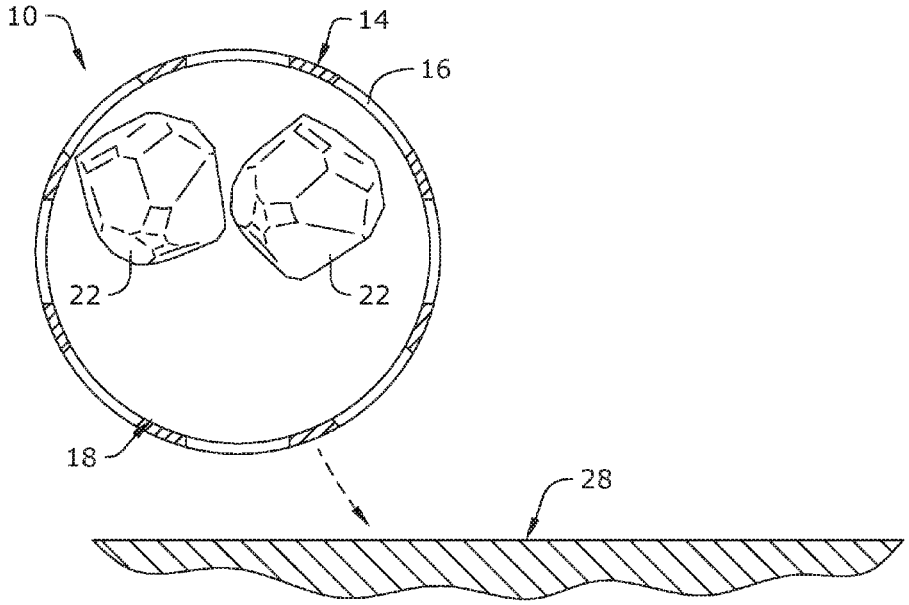
FIG. 5 is a section detail view of one embodiment of the present disclosure, taken along line 5-5 in FIG. 3.
Figure 6:
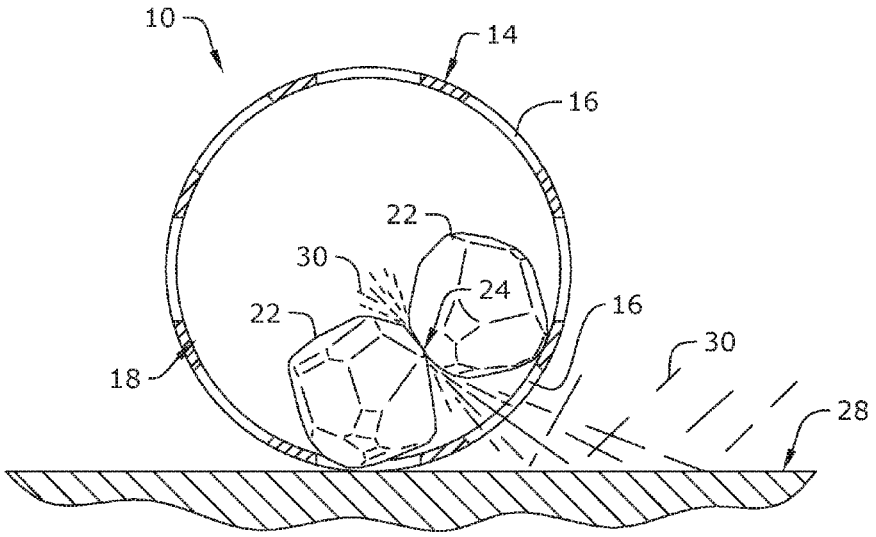
FIG. 6 is a section detail view of one embodiment of the present disclosure, taken along line 1-1 in FIG. 1.
Figure 7:
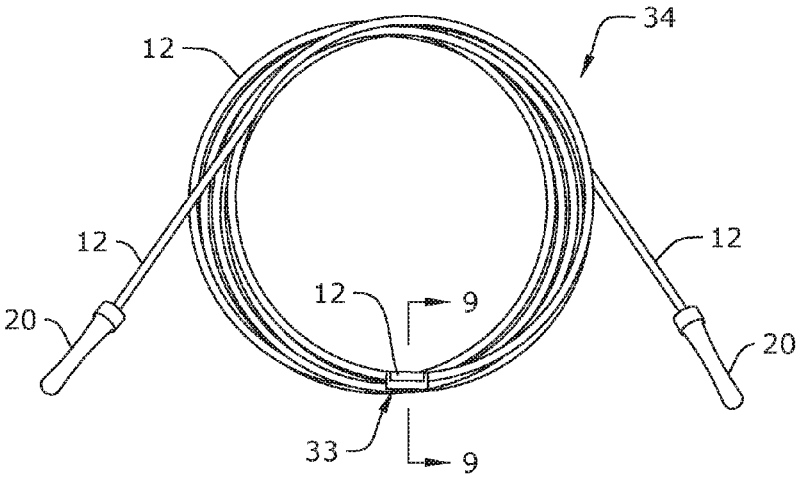
FIG. 7 is a perspective view of one embodiment of the present disclosure.
Figure 8:
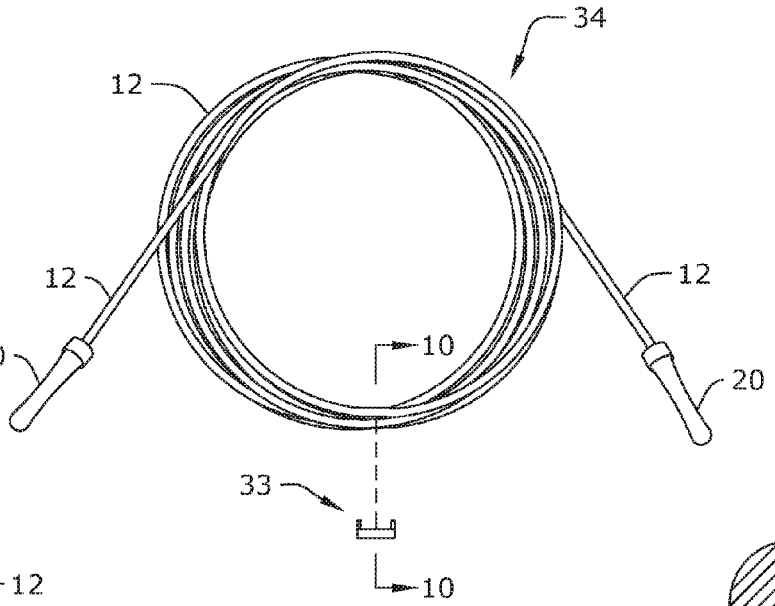
FIG. 8 is an exploded view of one embodiment of the present disclosure.
Figure 9:
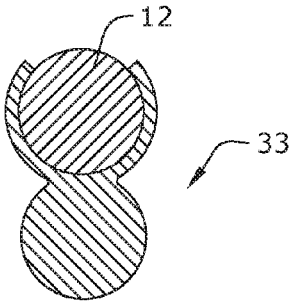
FIG. 9 is a cross sectional view of one embodiment of the present disclosure, taken along line 9-9 in FIG. 7.
Figure 10:
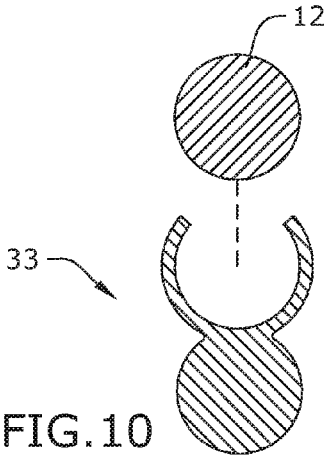
FIG. 10 is a cross sectional view of one embodiment of the present disclosure, taken along line 10-10 in FIG. 8.
Figure 11:
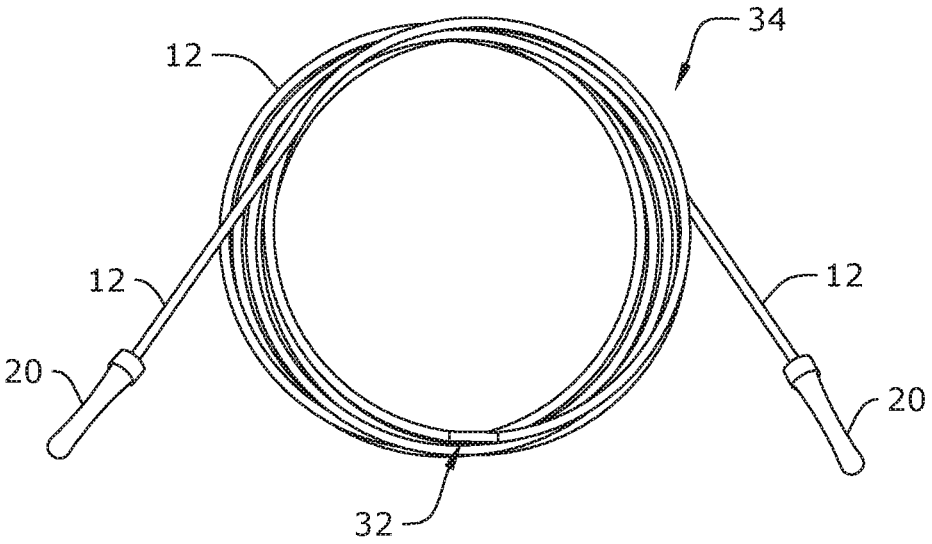
FIG. 11 is a perspective view of one embodiment of the present disclosure.

By way of example, and referring to FIGS. 1-11, some embodiments of the present disclosure include a sparking jump rope 10 comprising a sparking portion 14 positioned along a length of rope 12, the sparking portion creating sparks when the jump rope 10 contacts the ground 28. For example, in some embodiments, the sparking jump rope 10 comprises a rope 12, wherein a portion of the rope comprises a sparking portion 14. As shown in the Figures, the sparking portion 14 may be positioned proximate to a central area of the rope 12 such that the sparking portion 14 contacts the ground 28 creating sparks 30 when the jump rope 10 is used by a user 26.

In embodiments, the sparking portion 14 may be a hollow portion of the rope 12, wherein the sparking portion 14 has outer walls and an inner cavity 18 with a volume sufficient to accommodate at least one spark rock 22, wherein the outer walls comprise a plurality of orifices 16, wherein the orifices 16 have a size large enough for at least a portion of the spark rock 22 may contact the ground 28, and the orifices 16 are also smaller in size than a diameter of the spark rock 22, such that the spark rock 22 will not fall out of the sparking portion 14 through the orifices 16. In embodiments, the sparking portion 14 may contain a plurality of spark rocks 22, wherein the spark rocks 22 create sparks 30 when a first spark rock 22 contacts an adjacent spark rock 22 and the resulting sparks 30 exit the sparking portion 14 through the orifices 16. Thus, the spark rocks 22 may not have to contact the ground 28 to create sparks 30.

In other embodiments, an alternate sparking portion 32 may be built into the rope 12, wherein the alternate sparking portion 32 comprises a solid sparking material, such as steel, metal, flint, titanium, crystalline, and the like, wherein the alternate sparking portion 32 is configured to create sparks 30 when it contacts the ground 28. Alternatively, the sparking portion 32 may comprise the sparking material blended or intertwined into the rope 12.

In yet further embodiments, the sparking portion may be a removable attachment 33, as shown in FIGS. 7-10. For example, the removable sparking attachment 33 may clip around or otherwise attach to any conventional jump rope, such as rope 12. Thus, the present disclosure also includes an attachment 33 that may be fastened to any conventional jump rope to turn it into a sparking jump rope. When included, the fastener used to attach the sparking portion 32 to the rope 12 may be any suitable and known fastener.

The spark rocks 22 or sparking portion 32 may be made of any suitable material configured to produce sparks 30 when contacting another spark rock 22, sparking portion 32, or the ground 28. In embodiments, the spark rocks 22 or sparking portion 32 may have to contact adjacent spark rocks 22 or the ground 28 at a suitable force in order to emit sparks 30. Exemplary materials for the spark rocks 22 or the sparking portion 32 include metal, flint, steel, titanium, crystalline, or the like.

While the sparking portion 14, 32 are shown as being positioned in a substantially centrally located portion along the length of the rope 12 in the Figures, the sparking portion 14, 32 may be positioned at any suitable location along the length of the rope 12. Additionally, the sparking portion 14, 32 may come in varying sizes with varying numbers of spark rocks 22 or with varying sparking material depending on the desired intensity of the sparking.

As with conventional jump ropes, the jump rope of the current disclosure may also comprise a handle 20 at either end of the rope 12, wherein the handles 20 provide a user with a specific area of the jump rope to grip. Similarly, the jump rope of the present disclosure may comprise any additional features that conventional jump ropes may include, such as decorative features.

To use the jump rope of the present disclosure, a user would jump rope as normal. However, when the jump rope contacts the ground, sparks 30 may be produced by either spark rocks 22 colliding or hitting the ground, or the sparking portion 32 hitting the ground.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A sparking jump rope configured to emit sparks while a user is jumping rope, the sparking jump rope comprising:

a rope; and a sparking portion positioned along a length of the rope, the sparking portion configured to create sparks when the rope contacts a ground surface wherein the sparking portion comprises: a hollow portion of the rope, wherein the sparking portion has outer walls and an inner cavity with a volume to accommodate at least one spark rock, wherein: the outer walls comprise a plurality of orifices, the orifices having a diameter smaller than a diameter of the spark rock, such that the spark rock cannot pass through the orifices.

2. The sparking jump rope of claim 1, the sparking portion is positioned proximate to a central area of the length of the rope.

* * * * *